US005168318A

United States Patent [19]

Haneda et al.

[11] Patent Number: 5,168,318

[45] Date of Patent: Dec. 1, 1992

[54] COLOR IMAGE FORMING APPARATUS HAVING A PREDETERMINED SPACE MAINTAINED BETWEEN A PHOTOSENSITIVE BELT AND DEVELOPING DEVICES

[75] Inventors: Satoshi Haneda; Shizuo Morita; Masakazu Fukuchi; Shunji Matsuo, all of Hachioji, Japan

[73] Assignee: Konica Corporation, Tokyo, Japan

[21] Appl. No.: 592,578

[22] Filed: Oct. 4, 1990

[30] Foreign Application Priority Data

Oct. 18, 1989 [JP] Japan ..... 1-270815
Oct. 18, 1989 [JP] Japan ..... 1-270816

[51] Int. Cl.[5] ..... G03G 15/01

[52] U.S. Cl. ..... 355/326; 118/645; 355/212; 355/245

[58] Field of Search ..... 355/326, 327, 211, 212, 355/210, 219, 245, 213; 118/645, 653; 346/157

[56] References Cited

U.S. PATENT DOCUMENTS

| | | | |
|---|---|---|---|
| 4,279,496 | 7/1981 | Silverberg | 355/212 |
| 4,797,703 | 1/1989 | Guslits | 118/645 X |
| 4,806,991 | 2/1989 | Guslits | 355/212 |
| 4,896,191 | 1/1990 | Ohyabu et al. | 355/309 |
| 4,901,110 | 2/1990 | Tompkins et al. | 355/212 |
| 4,922,302 | 5/1990 | Hill et al. | 355/212 X |
| 4,924,272 | 5/1990 | Hediger et al. | 355/212 X |

FOREIGN PATENT DOCUMENTS

| | | | |
|---|---|---|---|
| 0142917 | 5/1985 | European Pat. Off. . | |
| 0321906 | 6/1989 | European Pat. Off. . | |
| 57-34576 | 2/1982 | Japan . | |
| 60-75850 | 4/1985 | Japan . | |
| 60-76766 | 5/1985 | Japan . | |
| 60-95456 | 5/1985 | Japan . | |
| 60-95458 | 5/1985 | Japan . | |
| 0120385 | 6/1985 | Japan | 355/212 |
| 60-158475 | 8/1985 | Japan . | |
| 61-100770 | 5/1986 | Japan . | |
| 61-149972 | 7/1986 | Japan . | |
| 0032482 | 2/1987 | Japan | 355/212 |

OTHER PUBLICATIONS

Patent Abstracts of Japan, vol. 9, No. 296, Nov. 22, 1985, Method for Making Single Color Copy Having Optional Tone.

Patent Abstracts of Japan, vol. 10, No. 361, Nov. 27, 1986, Multicolor Electrophotographic Copying Machine.

Research Disclosure, No. 192, Apr. 1980, Positioning an Electrophotographic Toning Station.

European Search Report.

*Primary Examiner*—A. T. Grimley
*Assistant Examiner*—William J. Royer
*Attorney, Agent, or Firm*—Frishauf, Holtz, Goodman & Woodward

[57] ABSTRACT

A color image forming apparatus wherein a photosensitive belt trained around a plurality of rollers is moved along a guide member, and the guide member is in contact under pressure by an elastic member with a space retaining member provided in each of image forming members facing the photosensitive belt. A color image forming apparatus wherein a photosensitive belt trained around a plurality of rollers is moved along a guide member, and each of given space retaining members is mounted coaxially with each of developing sleeves in the developing devices is in contact under pressure with the side end of the guide member facing the photosensitive belt by an elastic member.

3 Claims, 9 Drawing Sheets

COLOR IMAGE FORMING APPARATUS HAVING A PREDETERMINED SPACE MAINTAINED BETWEEN A PHOTOSENSITIVE BELT AND DEVELOPING DEVICES

BACKGROUND OF THE INVENTION

1. Field of the Invention

This invention relates to a color image forming apparatus adapted to form a toner image on a belt-shaped image retainer by an electrophotographic system, to transfer the toner image on a transfer material to obtain an object image.

2. Description of the Prior Art

Many methods and apparatuses for obtaining color images by using electrophotography have been proposed. As disclosed in, for example, Japanese Patent Laid-open No. 100770/1986, there is a method of obtaining a color copy by forming a latent image on a photosensitive drum serving as an image retainer in accordance with a color separation number of a document image, developing the latent image on the drum, transferring the resultant image onto a transfer drum every time the development of the latent image is completed to form a multi-color image on the transfer drum, and thereafter transferring the multi-color image onto a transfer material to obtain an object color copy. An apparatus realizing this method needs to be provided with a large transfer drum where a one-frame image is transferred on the circumferential surface thereof in addition to a photosensitive drum. Consequently, it is unavoidable that this apparatus has a large and complicated structure.

There is another method disclosed in, for example, Japanese Patent Laid-open No. 149972/1986, which comprises the steps of forming a latent image on a photosensitive drum in accordance with the color separation number of a document image, developing the latent images on the drum, and transferring the resultant image onto a transfer material every time the development of the latent image is completed, to obtain a multi-color copy. In this method, it is difficult to accurately superpose each of monochromatic images one upon another, so that a high-quality multi-color copy cannot be obtained.

There is also another method of obtaining a color image, which comprises the steps of repeating formation of a latent image on a photosensitive drum in accordance with the color separation number of a document image and development of the latent images with color toners, superposing color toner images one upon another on the photosensitive drum, and then transferring the resultant image onto a transfer material. The basic processes for formation of such a multi-color image are disclosed, for example, in Japanese Patent Laid-open Nos. 75850/1985, 76766/1985, 95456/1985, 95458/1985 and 158475/1985.

In a multi-color image forming apparatus for obtaining a color image by such an image superposing step, a plurality of developing devices storing different color toners therein are arranged around a photosensitive drum, and a latent image on this drum is developed by rotating the same drum generally a plurality of times to obtain a color image.

In addition to the photosensitive drum which has a photoconductive material applied or evaporated on the circumferential surface of the drum as described above, a belt-shaped image retainer which has a photoconductive material applied or attached to a flexible belt has also been proposed.

The belt-shaped image retainer(photosensitive belt) is formed by training the image retainer around rollers including a drive roller. Thus, this design is advantageous when constructing a color image forming apparatus in a compact form by utilizing the space efficiently. Also, because the photosensitive belt can run along a curve with a sharp curvature, a small diameter driving roller can be employed to utilize this curvature for separating the transfer material to prevent a defective separation thereof.

In a color image forming apparatus using the photosensitive belt, image forming means comprising a charging means, an image exposing means, and a plurality of developing devices, are provided on the circumference of said photosensitive belt in such a way that these image forming means face the photosensitive belt with a given space therebetween.

In order to allow the image forming means to face the photosensitive belt while keeping the given space therebetween, back up rollers are employed. However, this method of using back up rollers needs as many rollers corresponding to the image forming means. If such a large number of rollers are employed, difficulties are encountered in maintaining the parallelism with said driving roller. Also, there is proposed an apparatus, such as disclosed in Japanese Patent Laid-open No. 34576/1982, in which the image forming means is positioned to face the photosensitive belt running on the guide members. However, it is difficult for an apparatus, such as this, to provide a given space required.

In the case of a photosensitive drum, a rotating roller functioning as a space retaining member is mounted coaxially with a developing roller in the developing device and the developing device is in contact with the photosensitive drum under pressure. However, in the case of a photosensitive belt, if the rotating roller is used as a means to retain a given space, the load applied to the photosensitive belt is increased when the roller is in contact therewith and slippage and other undesirable operations are generated.

SUMMARY OF THE INVENTION

The purpose of the present invention is to provide a color image forming apparatus with a photosensitive belt capable of obtaining excellent images by enabling the image forming means to face the photosensitive belt accurately with a given space without any unnecessary increase in the load applied to the rotating photosensitive belt.

The above-mentioned purpose is achieved by a color image forming apparatus comprising a photosensitive belt which is trained around a plurality of rollers and is slidably rotated along guide members, and a plurality of image forming means which face said photosensitive belt, characterized in that each of said guide members is in contact under pressure by an elastic member with a space retaining member provided in each of the image forming means. Here the image forming means is a charging device, an exposing means, or a developing device.

Also, the above-mentioned purpose is achieved by a color image forming apparatus comprising a photosensitive belt which is trained around a plurality of rollers and slidably rotated along guide members, and a plurality of developing devices facing said photosensitive belt, characterized in that each of given space retaining members mounted coaxially with each of developing sleeves in the developing devices is in contact under pressure with the side end of said guide member by an elastic member.

Other purposes and features of the present invention will be apparent from the following description with reference to the accompanying drawings.

DESCRIPTION OF PREFERRED EMBODIMENTS

An embodiment of a color image forming apparatus according to the present invention is shown in FIGS. 1 through 6.

Figure 1:
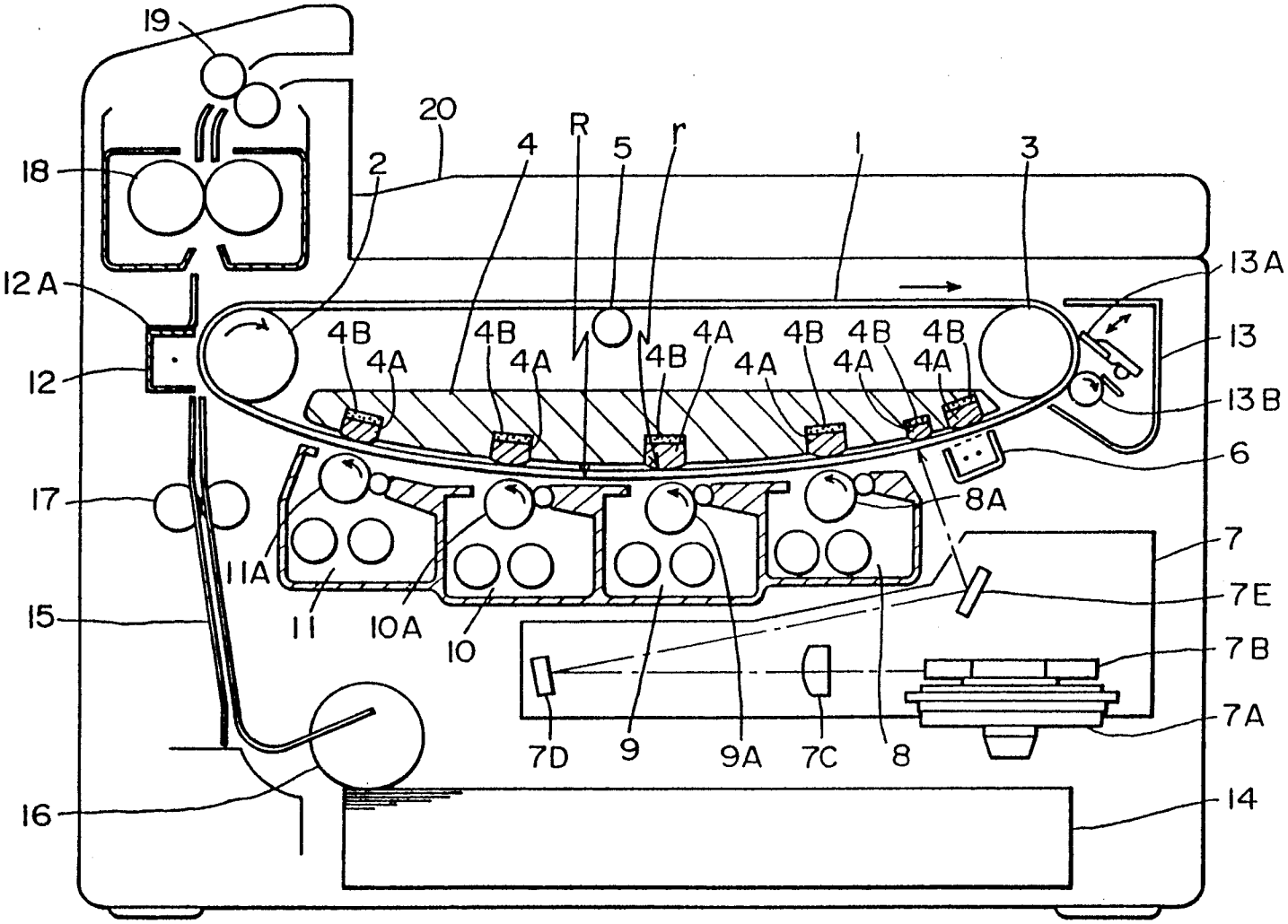
FIG. 1 and FIG. 6 are sectional views showing a color image forming apparatus according to the present invention.

Referring to FIG. 1, a reference numeral 1 denotes a flexible photosensitive belt constituting a belt-shaped image retainer, which is trained around rollers 2, 3 and turned clockwise by the driving force of the roller 2.

A reference numeral 4 denotes a guide member fixed to the apparatus so as to guide the photosensitive belt 1, which is tensed by an operation of an upwardly biased tension roller 5 to be brought into slidable contact at the inner circumferential surface thereof with the guide member 4.

Accordingly, the photosensitive material on the outer circumferential surface of the photosensitive belt 1 can always keep a constant positional relation with respect to the surface of the guide member 4 even while the photosensitive belt 1 is run, so that a stable image forming surface can be obtained.

A reference numeral 6 denotes a changing device, such as a scorotron charger, 7 a laser writing unit, operating as an image exposing means, and 8 to 11 a plurality of developing devices, i.e. developing means respectively containing developers of predetermined colors. These developing means are arranged facing the outer circumferential surface of the photosensitive belt 1 backed by the guide member 4.

In the laser writing unit 7, an optical system of a unitary combination of a light emitting element and a convergent light transmission member is used, besides the optical system shown in the drawing.

The developing devices 8, 9, 10 and 11 contain, for example, yellow, magenta, cyan and black developers respectively, and are provided with developing sleeves 8A, 9A, 10A and 11A which retain predetermined clearances between the developing devices and photosensitive belt 1, the developing devices operating to connect a latent image on the photosensitive belt 1 into a visible image by a non-contact developing method. This non-contact developing method, unlike the contact developing method, has an advantage that the movement of the photosensitive belt 1 is not interfered with.

A reference numeral 12 denotes a transfer device, 12A a charge eliminating bar, and 13 a cleaning device as a cleaning means. A blade 13A and a toner feeding roller 13B in this cleaning device are retained in the positions apart from the surface of the photosensitive belt 1 during the formation of an image, and they are pressed against the surface of the photosensitive belt 1 as shown in the drawing, only while a cleaning operation is carried out after the completion of the transferring of the image.

Figure 2:
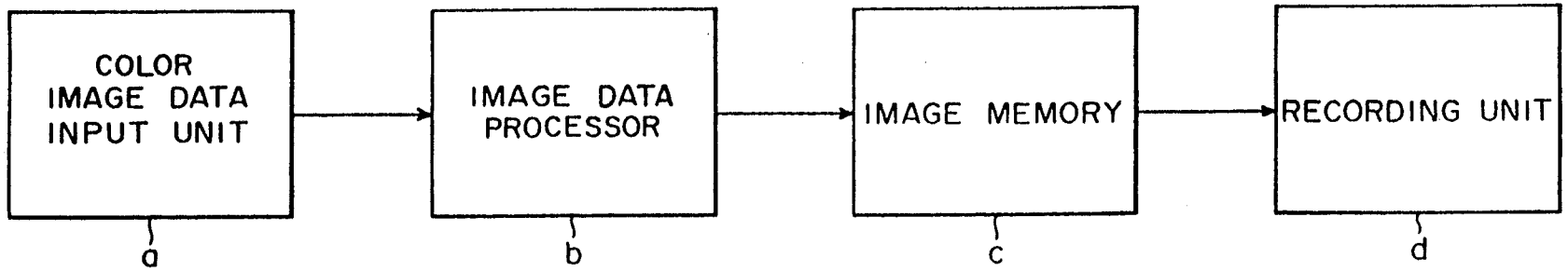
FIG. 2 is a block diagram showing an image forming system.

A color image forming process by this color image forming apparatus is carried out as follows:

The formation of a multi-color image by this embodiment is carried out in accordance with an image formation system shown in FIG. 2. Namely, the data obtained in a color image data input unit a in which an original image is scanned by an image pickup element are operated in an image data processor b to prepare image data and store the data temporarily in an image memory c. The image data are then taken out in a recording step and inputted into, for example, the color image forming apparatus serving as a recording unit d of the embodiment of FIG. 1.

When a color signal outputted from an image reading apparatus provided independent of the color image forming apparatus is inputted into the laser writing unit 7, a laser beam emitted from a semiconductor laser (not shown) is subjected to rotational scanning by a polygon mirror 7B therein which is turned by a driving motor 7A, and the optical path of the laser beam is then bent by mirrors 7D, 7E via a $f\theta$ lens 7C, the laser beam being thereafter projected on the circumferential surface of the photosensitive belt 1 which has been charged by the charging device 6 provided as a charging means to form a static latent image.

When the scanning is started, the laser beam is detected by an index sensor, and the modulation of the laser beam in accordance with a first color signal is started, the circumferential surface of the photosensitive belt 1 being scanned with the modulated laser beam. Thus, a latent image corresponding to the first color is formed on the circumferential surface of the photosensitive belt 1 by the primary scanning with the laser beam and the auxiliary scanning based on the movement of the photosensitive belt 1. This latent image is developed by the developing device 8 containing a yellow (Y) toner (developing medium) among the developing means in this apparatus, to form a yellow toner image on the surface of the belt 1. The toner image thus obtained passes under the cleaning unit 13 placed apart from the circumferential surface of the photosensitive belt 1, as the image is left on the drum, to proceed to a subsequent copying cycle.

The photosensitive belt 1 is charged again by the charging device 6, and a second color signal outputted from the signal processor is then inputted into the writing unit 7, the writing on the surface of the belt being done in the same manner as in the case of the writing based on the first color signal, to form a latent image. This latent image is developed by the developing device 9 containing a magenta (M) toner as a second color developer. This magenta toner image is formed in the presence of already-formed yellow toner image.

A reference numeral 10 denotes a developing device containing a cyan developer with which a cyan toner image is formed on the basis of an image signal generated in the signal processor.

A reference numeral 11 denotes a developing device containing a black developer, with which a black toner image is formed on the already-formed toner images on the circumferential surface of the photosensitive belt 1 by the same process as mentioned above. A DC or AC bias voltage is applied to the sleeves in these developing devices 8, 9, 10 and 11, and a jumping developing is carried out with a developing means, i.e. a two-component developer, whereby a non-contact development is carried out on the photosensitive belt 1 the base body of which is grounded. Otherwise, a non-contact development using a one-component developer may be selected.

The color toner image thus formed on the circumferential surface of the photosensitive belt 1 is transferred in the transfer unit on the transfer paper fed through a paper feed guide 15 from a paper feed cassette 14.

The transfer paper stored in the paper feed cassette 14 is sent out piece by piece with the topmost one first by the rotation of the paper feed roller 16 toward the transfer unit 12 via a timing rollers 17 in synchronism with the image formation on the photosensitive belt 1.

The transfer paper which has been subjected to the transferring of an image and the elimination of charge is separated reliably from the photosensitive belt 1, the direction of movement of which is suddenly changed along the roller 2, to advance upward. The image is then fixed by the fixing rollers 18, and thereafter the transfer paper is delivered onto the tray 20 via the paper delivery rollers 19.

On the other hand, after completing the image transfer to the transfer material, the photosensitive belt 1 still continues its movement to remove the remaining toner in said cleaning device 13 wherein the blade 13A and the toner feeding roller 13B are in contact with the belt. With this process completed, said blade 13A is again separated. Slightly after that, the toner supply roller 13B smooths the toner deposited on the top end of the blade 13A. Then the toner supply roller 13B is separated and the system proceeds to the next image forming process.

Said guide member 4 has its conveying surface formed into a curved surface having a comparatively large curvature radius R where the photosensitive belt 1 is slidably in contact while holding a plurality of projecting movable members 4A each having a smaller curvature radius r than radius R of said conveying surface at locations facing each of said image forming means.

Each of said movable members 4A is fitted along with an elastic member 4B into each of a plurality of grooves provided in the guide member 4. Elastic 4B is formed of a suitable material, such as Moltoprene (Trade Name), with an appropriate elasticity of said elastic member 4B being such as to press the photosensitive belt 1 outwardly to keep the belt in a tension condition.

Said movable members 4A are placed at six locations which consist of the four developing sleeves 8A, 9A, 10A, and 11A one facing the charging device 6, and the exposure portion of the laser optical unit 7.

Therefore, the photosensitive belt 1 is in contact with the guide member 4 only through each of the top ends of said movable members 4A, and assures a reliably slidable condition with a uniform pressing contact force. Thus the surface of the photosensitive belt 1 facing each of the image forming means is allowed to be always positioned at a given location accurately while being transferred at a given speed smoothly because the frictional resistance is reduced.

Meanwhile, in each of the developing devices, the press contact of said movable member 4A against a space retaining member which will be described below can regulate the relative position between each of the developing sleeves and the surface of the photosensitive belt 1. Hence a developing region with an appropriate space between the belt and the developing sleeves is formed to perform the non-contact developing set forth above.

The structure and function of each of the developing devices will below be described with reference to the developing device 9 as an example.

Figure 3:
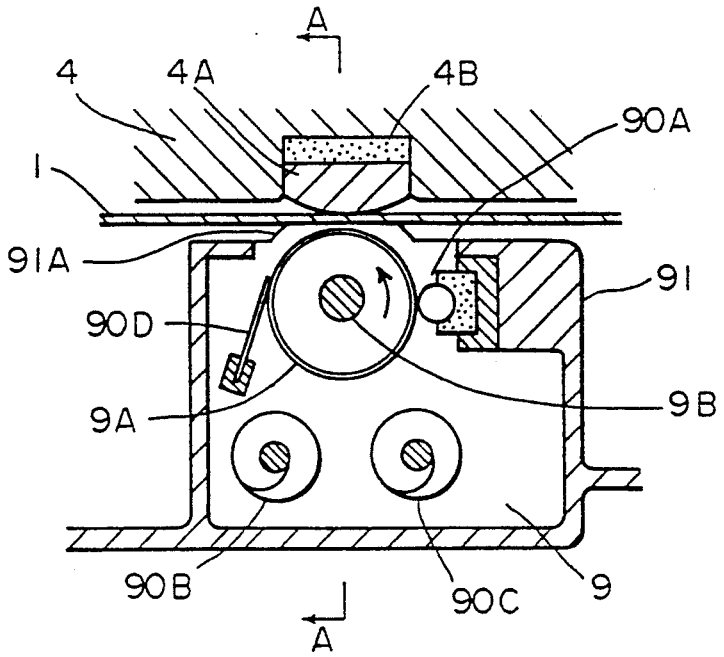
FIG. 3 and FIG. 4 are views showing each of the cross sections of a developing device.
Figure 4:
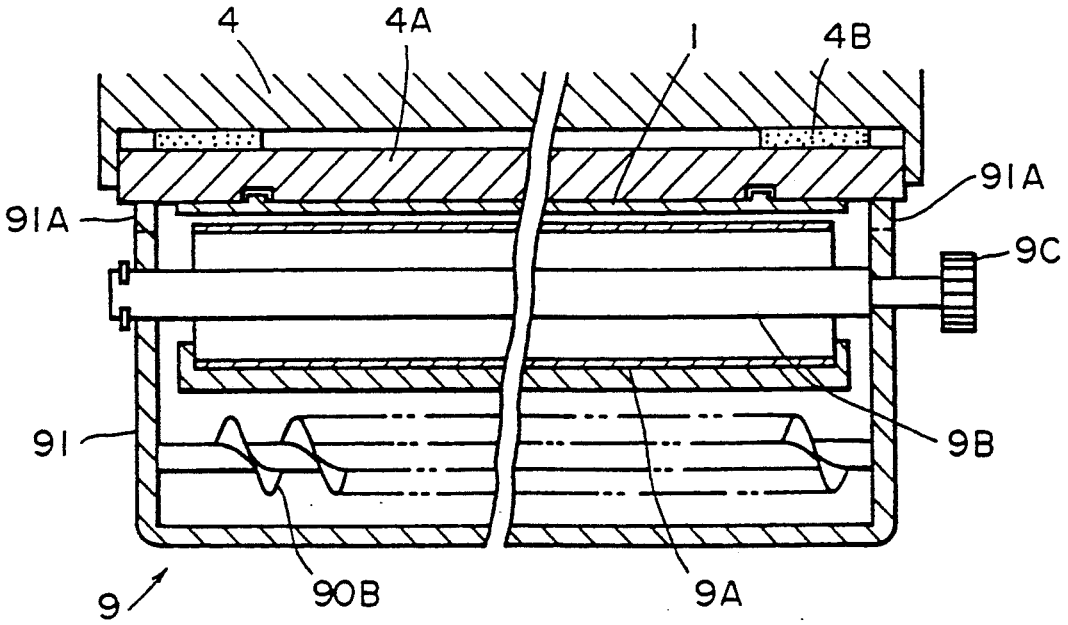

FIG. 3 illustrates the details of the developing device 9, and FIG. 4 shows the cross section thereof taken on line A—A of FIG. 3.

In the figures, a reference numeral 9A denotes a developing sleeve with a built-in magnetic roller, and 9B denotes its rotational shaft. The developing sleeve 9A is rotated by a driving system in the body of the apparatus through a gear 9C mounted at the end of the rotational shaft 9B in the same direction in which the photosensitive belt 1 is transferred, i.e., the sleeve is driven to rotate counterclockwise in FIG. 3.

A reference numerals 90A denotes a thin layer forming member having both rigidity and magnetism, which is in contact under pressure with the developing sleeve 9A with a given load when there is no developer. Reference numerals 90B and 90C denote a pair of toner transfer screws for transferring and circulating the developer in the direction reverse to each other using the screw mechanism. The function of this screw system is to transfer to the developing sleeve 9A the developer which is prepared by stirring and mixing toner and carrier sufficiently therein.

Said toner transfer screw 90B and said toner transfer screw 90C are members which also function as stirring members rotating in the directions reverse to each other. The toner and carrier transferred inwardly by the thrust of the toner transfer screw 90B are moved into the toner transfer screw 90C side. Then the toner and carrier are transferred by its thrust toward the forward side of the figure, and are prepared as homogeneous developer which is frictionally charged while they are mixed during the course of the transfer. They are thus attached to the circumference of the developing sleeve 9A to form a layer thereon.

While the latent image formed on the surface of the photosensitive belt 1 is being transferred clockwise, this thin layer of the developer attached to the circumference of the developing sleeve 9A causes the latent image to be reversely developed in the developing region with said developing space maintained therebetween. Hence a toner image is formed without any contact.

During this non-contact development, a developing bias voltage having alternating current component in addition to direct current component is applied to said developing sleeve 9A from the power supply (not shown). As a result, only the toner of the developer deposited on the developing sleeve 9A is selectively transferred and attached onto the surface of said latent image.

When the toner component is consumed, the ratio of the carrier becomes higher in the developer which is transferred further by the developing sleeve 9A so as to be separated by a scraper 90D for collection. Then a developer with a higher ratio of toner is mixed thereto.

Said developing device 9 forms projections 91A each at the top of the front and rear sides of the developer container 91 as space retaining members which maintain a given height with respect to the developing sleeve 9A, and when the developing device 9 is mounted on the body of the apparatus, each of the projections 91A is positioned at a location to be in contact under pressure with said movable member 4A. Thus the space between the developing sleeve 9A and the surface of the photosensitive belt 1 is correctly set to a given value.

Likewise, as to the charging device 6 and image exposing means, the space between the surface of the photosensitive belt 1 and each of them is set to a given value by allowing them to be in contact under pressure with the respective movable members 4A facing one another in the same way as in the case of the developing sleeve in each of said developing devices.

Figure 5:
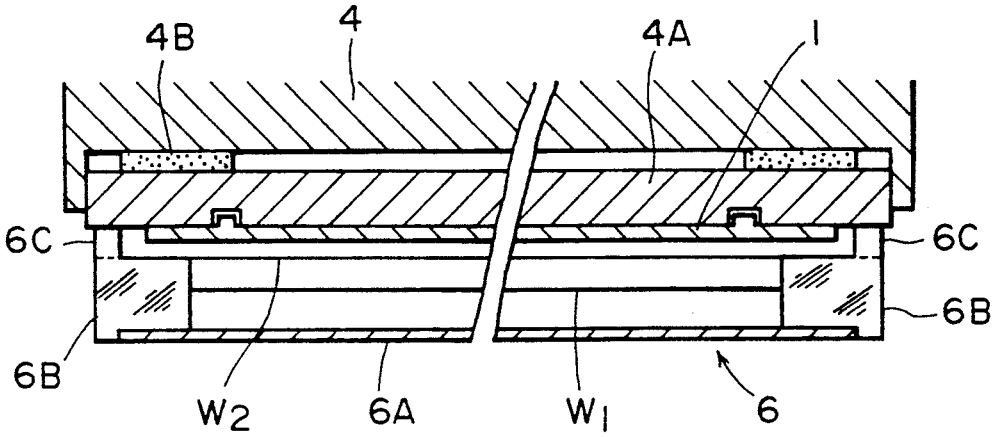
FIG. 5(A) and FIG. 5(B) are views showing each of the cross sections of a charging means and an image exposing optical system.
Figure 5:
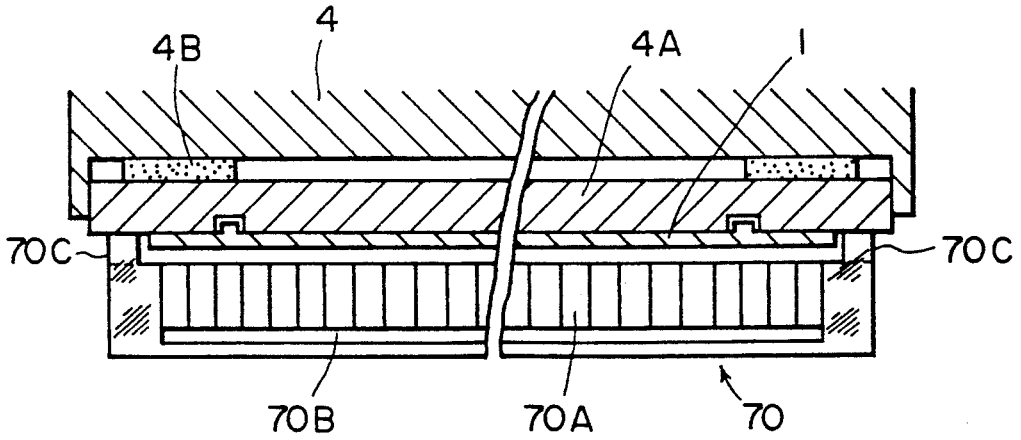

In FIG. 5 (A), a reference numeral 6A denotes a back plate of the charging device 6 and a reference numeral 6B denotes each of the electrode blocks mounted at both ends of said back plate 6A. A reference numeral $W_1$ denotes a wire stretched between said electrode blocks 6B, and $W_2$, a grid.

In each of said electrode blocks 6B, each of projections 6C is formed integrally as a space retaining member which maintains a given height with respect to said wire $W_1$. The charging device 6 is accurately positioned with respect to the surface of the photosensitive belt 1 by each of said projections 6C which is in contact under pressure with the movable member 4A in said guide member 4 outside the photosensitive belt 1.

Furthermore, FIG. 5(B) illustrates an optical system 70 having a converging photoconductive member as an image exposing means in place of the laser optical system, which comprises an optical system in which a converging photoconductive member 70A and an light emitting member 70B, such as LED, are integrated. Said light emitting member 70B has at the both ends of casing each of the projections 70C integrally formed therewith as a space retaining member with a given height, and is in contact under pressure with the movable member 4A of said guide member 4, thereby a space is formed to provide an accurate focusing on the surface of the photosensitive belt 1 by an image exposing light.

In FIG. 4, the developer container 91 and the guide member 4 including the photosensitive belt are separate structures so as to make each of them freely detachable independently. However, the process unit including the photosensitive member and the developing device can be formed as one body freely detachable.

Figure 6:
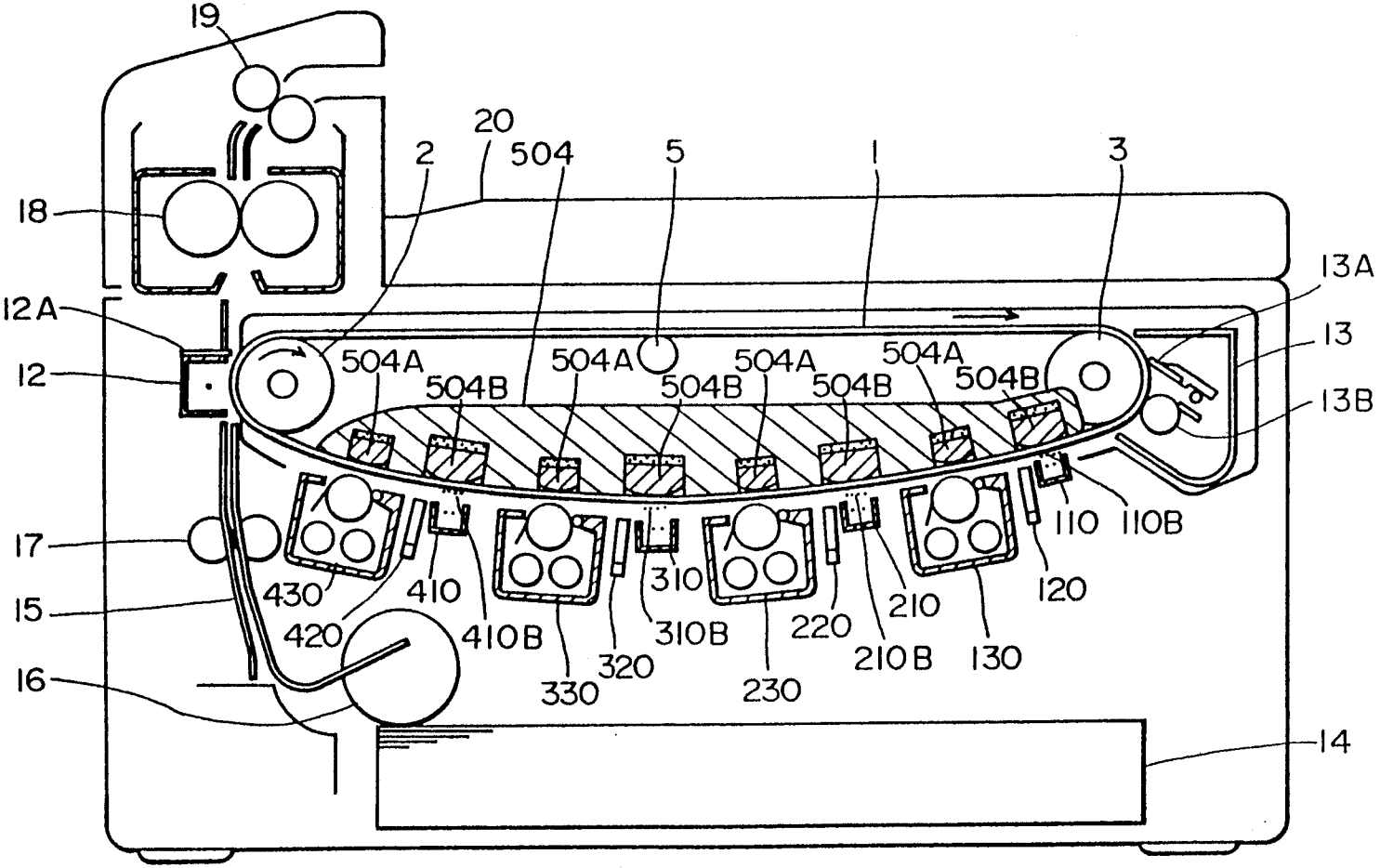

Although a color image forming apparatus for forming a color image by the four revolutions of the photosensitive belt is described, the present invention is also applicable to an image forming apparatus for producing a full color image with one revolution of the photosensitive belt 1 as shown in FIG. 6.

In a color image forming apparatus, a plurality of charging devices 110, 210, 310, and 410, and a plurality of image exposing devices 120, 220, 320, and 420 are arranged for forming the latent images of the respective colors in parallel with a plurality of developing devices 130, 230, 330, and 430 which contain toners of the respective colors. Grids 110B, 210B, 310B and 410B, like grid W2 shown in FIG. 5(A), are arranged in charging devices 110, 210, 310, 410, respectively. Hence, in a guide member 504, movable members are provided in eight locations, i.e., the movable members 504A are arranged in four locations facing the developing devices 130, 230, 330, and 430 respectively, and the movable members 504B are arranged at four locations facing each of the combinations of the electrostatic chargers 110, 210, 310, and 410 and the image exposing devices 120, 220, 320, and 420. The position of the surface of the photosensitive belt facing each of the image forming means is established by the press contact with each of the space retaining members in the same way as in the case of the previous embodiment.

Figure 7:
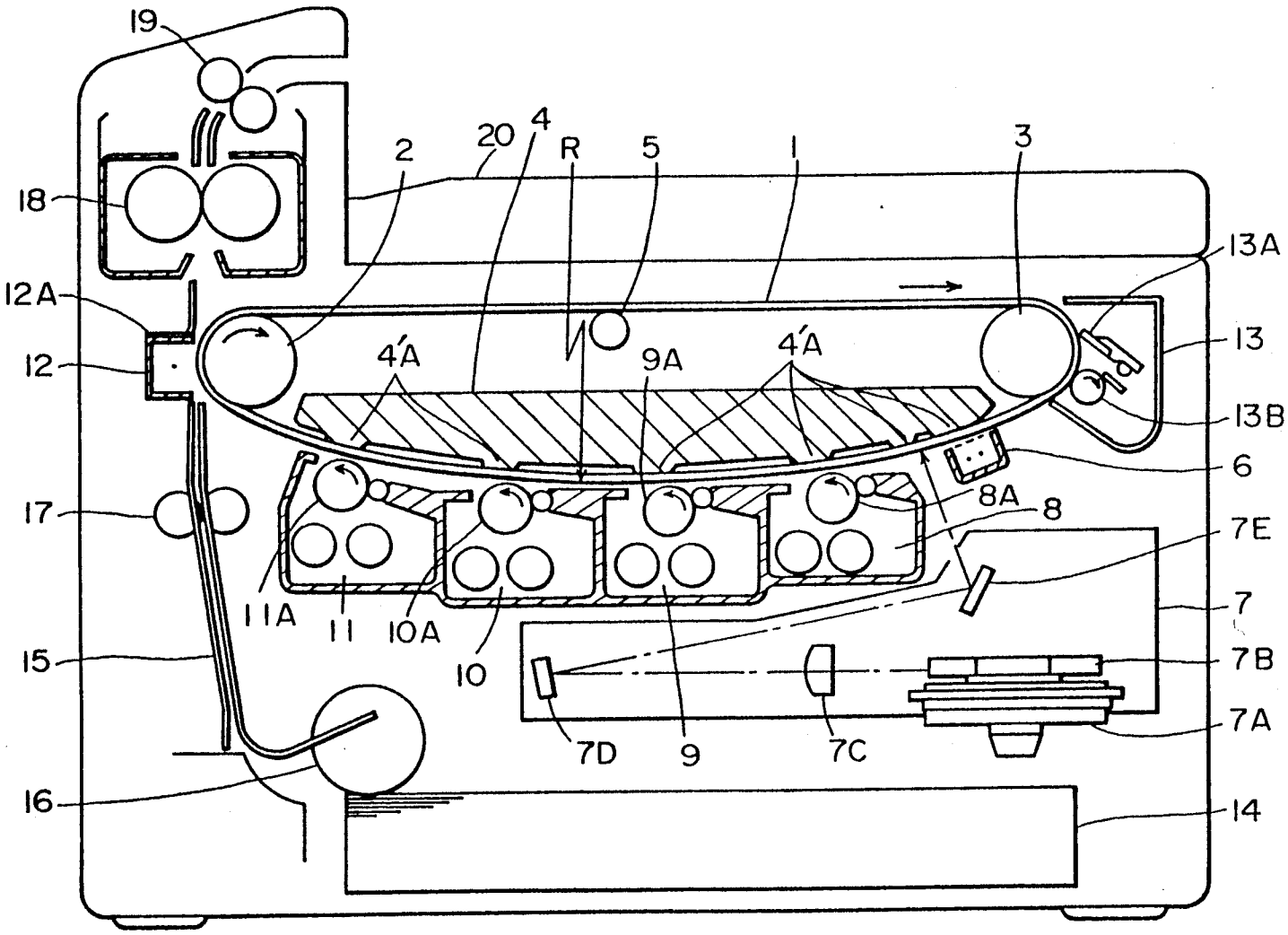
FIG. 7 and FIG. 8 are sectional views showing other embodiments of a color image forming apparatus according to the present invention.

In another embodiment according to the present invention, a plurality of projections 4'A are provided in said guide member 4 in the locations facing each of said image forming means as shown in FIG. 7.

Said projections 4'A are arranged at a total of six locations with four facing the developing sleeve 8A, 9A, 10A, and 11A in each of the developing devices, one facing the charging device 6, and one facing the exposing portion of the laser writing unit 7. Adjacent ones of the projections 4'A are connected to each other by the respective portions of guide member 4 which are slightly retracted from said projections.

Therefore, the photosensitive belt 1 is in contact with the guide member 4 only through the top ends of said projections 4'A so as to obtain the same effect as the embodiment previously described.

Figure 9:
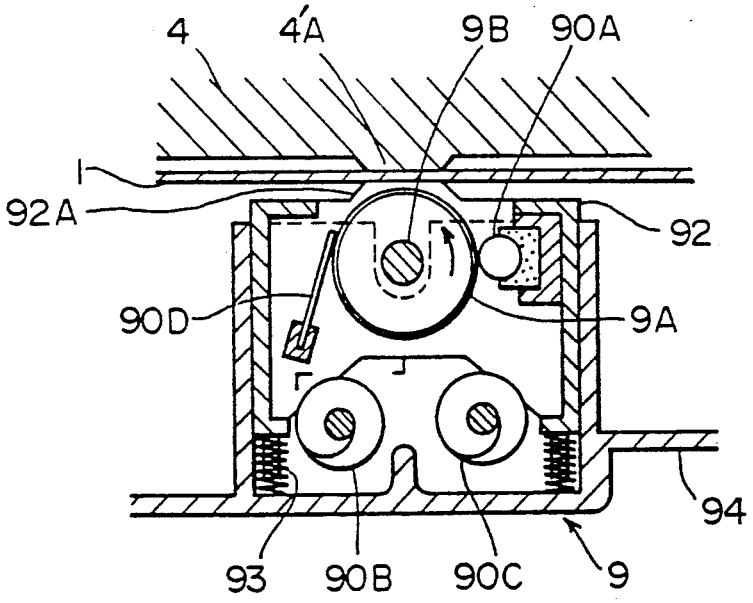
FIG. 9, FIG. 10, and FIG. 11 are sectional views each showing the structure of a developing device.
Figure 10:
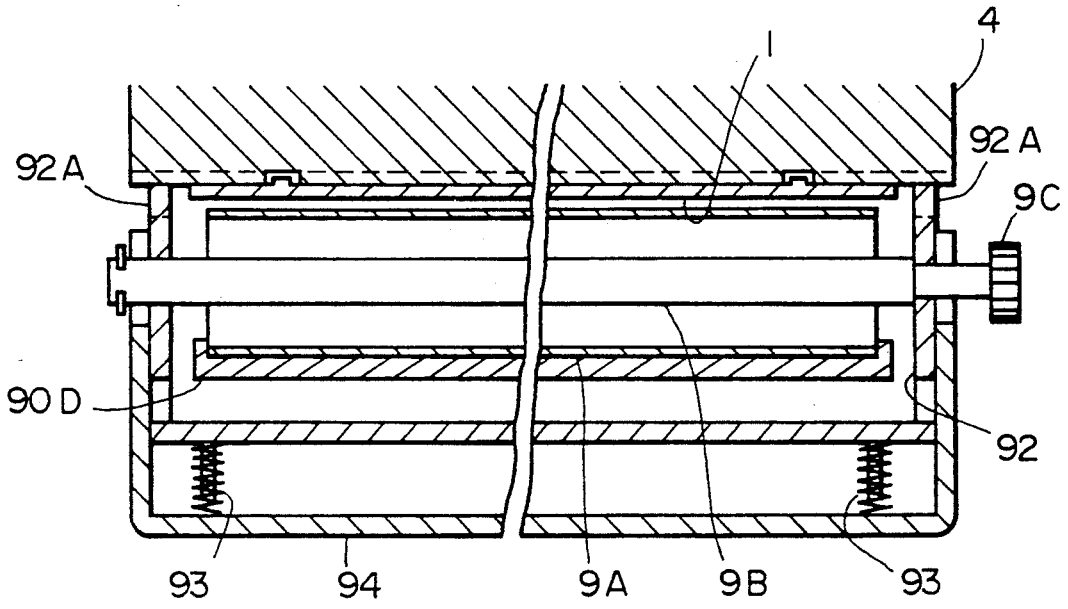

In a developing device shown in FIGS. 9 and 10, said toner transfer screws 90B and 90C are supported by an outer frame 94 which holds each of the developing devices integrally while said developing sleeve 9A, thin layer forming member 90A and scraper 90D are installed on an inner frame 92 which is movable slidably and vertically within said outer frame 94.

Said inner frame 92 is an oblong cylindrical container with openings at its upper and lower ends, and provides projections 92A each at the top end of front and rear sides as space retaining members with a given height with respect to the developing sleeve 9A, and is always pressed upwardly by an elastic member, i.e., a compression spring 93, arranged compressedly between the bottom thereof and the outer frame 94. Hence said projections 92A are in contact under pressure with the external side of the photosensitive belt 1 where projections 4A of the guide member 4 are located. As a result, the circumference of the developing sleeve 9A is accurately positioned at a given location facing the surface of the photosensitive belt 1 without difficulties in the transfer of the photosensitive belt.

Figure 11:
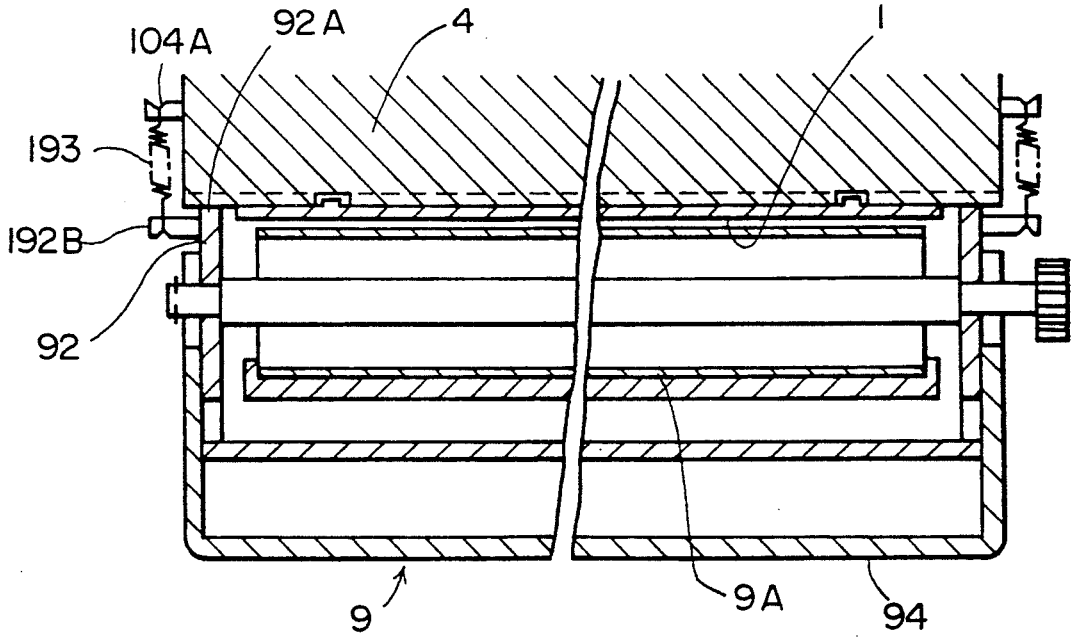

FIG. 11 illustrates an example of controlling the position of the developing sleeve 9A by a tension spring 193 in place of the compression spring. In this example, each one pair of projections 104A and 192B facing respectively the guide member 4 and the inner frame 92 are provided, and the tension spring 193 is tensioned between each of these projections to always pull the inner frame 92 upwardly so as to maintain the projection 92A of the inner frame 92 in contact under pressure with the projection of the guide member 4. In this case, it is desirable that each of said projections 104A and 192B are both arranged on the vertical line extending from the axial center of the developing sleeve 9A.

In FIG. 11, the outer frame 94 and the guide member 4 including the photosensitive belt are constructed as separate members, and each of them can be freely detached independently. However, the process unit including the photosensitive member and the developing devices can be formed as one body to be freely detachable.

Figure 8:
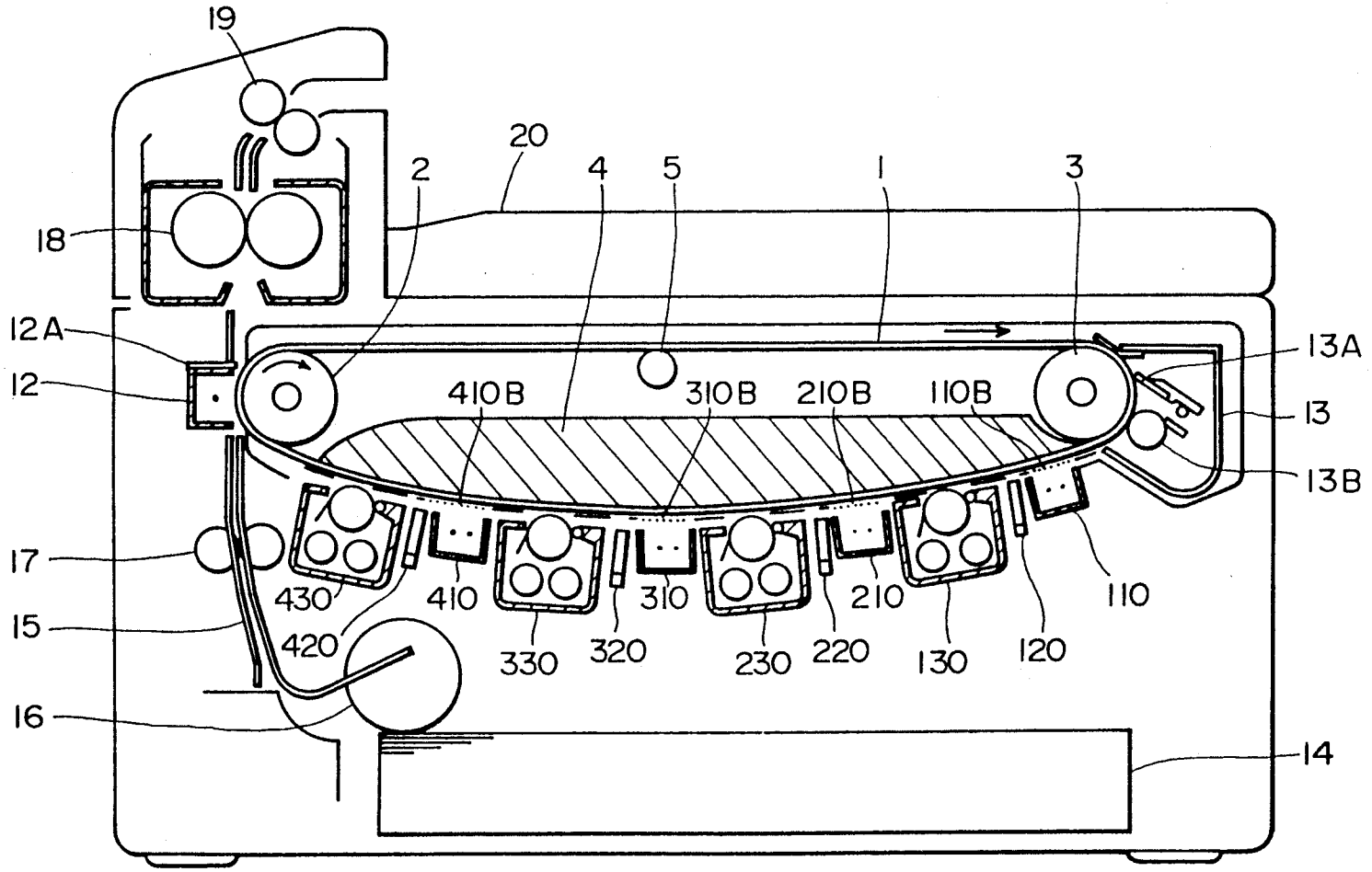

In this respect, although a color image forming apparatus which forms a color image by a four revolutions of the photosensitive belt is described in this embodiment, the present invention is also applicable to a color image forming apparatus for producing a full color image by one revolution of the photosensitive belt 1 according to still another embodiment as shown in FIG. 8.

In a color image forming apparatus, a plurality of the developing devices 130, 230, 330, and 430, each containing toner for different color, are arranged to form groups comprising each of the charging devices 110, 210, 310, and 410, and each of the image exposing devices 120, 220, 320, and 420. Grids 110B, 210B, 310B and 410B, like grid W2 shown in FIG. 5(A), are arranged in charging devices 110, 210, 310, and 410, respectively. However, it is possible to arrange a structure where each of the developing devices can be mounted on the fixed outer frame and on the inner frame vertically movable independently for the fixed outer frame as in the previous embodiment. Thus, in this embodiment, the similar space retaining members can be formed in the inner frame in order to establish a relative position of the developing sleeve which faces the photosensitive belt accurately.

EFFECT OF THE INVENTION

According to the present invention, a flexible photosensitive belt used for an image forming apparatus can be transferred at a stable speed after being positioned at a given location accurately. Hence, it is possible to provide a compact color image forming apparatus which enables each of the image forming means to operate to full capacity so as to produce high-quality color images at all times.

What is claimed is:

1. A color image forming apparatus, comprising:

a photosensitive belt trained around a plurality of rollers and slidably rotated along guide means, said belt having an imaging surface and a back surface;

a plurality of developing devices positioned at intervals along a direction of travel of said photosensitive belt and integrally formed as one body, each of said developing devices facing said imaging surface of said photosensitive belt to form an image thereon;

said guide means including a plurality of guide members distributed along said direction of travel of said photosensitive belt and corresponding in position, respectively, to said plurality of developing devices; and a plurality of spacing means for maintaining said plurality of developing devices at a predetermined distance from said photosensitive belt throughout a color image forming operation, wherein each of said plurality of spacing means comprises a projection on one of said plurality of developing devices extending toward a corresponding one of said plurality of guide members, and each of said guide members is in contact with said back surface of the photosensitive belt, and is in contact under pressure with said projection.

2. The color image forming apparatus of claim 1, wherein said guide member is biased by an elastic member.

3. The color image forming apparatus of claim 1, wherein said guide member is movable.

* * * * *